United States Patent [19]

Tudisco

[11] 4,331,193

[45] May 25, 1982

[54] FLEXIBLE HANDLE FOR PERCUSSIVE TOOL EMPLOYING IMPROVED SHAFT MEMBER

[75] Inventor: Vincent J. Tudisco, Westwood, N.J.

[73] Assignee: White Development Corporation, Bennington, Vt.

[21] Appl. No.: 157,649

[22] Filed: Jun. 9, 1980

[51] Int. Cl.[3] ..... B25C 1/00

[52] U.S. Cl. ..... 145/29 R; 145/29 B; 145/61 H

[58] Field of Search ..... 145/61 R, 61 A, 61 B, 145/61 C, 61 D, 61 H, 29 R, 29 B; 254/19, 26 R

[56] References Cited

U.S. PATENT DOCUMENTS

| | | | |
|---|---|---|---|
| 31,997 | 4/1861 | Phillips . | |
| 1,515,708 | 11/1924 | Stolle . | |
| 1,794,008 | 2/1931 | Forbes . | |
| 2,741,456 | 4/1956 | Williams . | |
| 3,208,724 | 9/1965 | Vaughan . | |
| 3,770,033 | 11/1973 | Gavillet et al. | 145/61 H |
| 3,833,037 | 9/1974 | Fish | 145/61 H |
| 4,096,895 | 6/1978 | Fernitz . | |

FOREIGN PATENT DOCUMENTS

| | | | |
|---|---|---|---|
| 123021 | 10/1948 | Sweden | 145/61 H |

*Primary Examiner*—James L. Jones, Jr.
*Attorney, Agent, or Firm*—Mandeville and Schweitzer

[57] ABSTRACT

A hammer handle is made of a spring strip formed into an oblong closed figure and a synthetic resin handle body molded around the frame. The closed figure is interrupted at one point along the front longitudinal side. Abutment of the free ends at the discontinuity prevents the frame and thus the handle from flexing in one direction when the hammer claw is used, but the free ends part to permit the handle to flex in the other direction and thereby reduce the shock resulting from striking a workpiece.

19 Claims, 6 Drawing Figures

FLEXIBLE HANDLE FOR PERCUSSIVE TOOL EMPLOYING IMPROVED SHAFT MEMBER

BACKGROUND OF THE INVENTION

The present invention relates to hand impact tools and their handles. In particular, it is concerned with shock-absorbing handles that are flexible in one direction but not in the other.

The traditional hickory hammer handle has been successfully employed for a long time and is still reasonably popular. However, the relative costs of the hickory and competing materials, as well as some favorable characteristics of the competing materials, have resulted in a trend away from the traditional handle.

Even before this relatively recent trend away from the traditional handle, some reevaluation of the desirable characteristics of a hammer handle had occurred. Specifically, it was recognized that it may not be desirable for the hammer hanlde to be excessively rigid, because an excessively rigid handle tends to transmit shock to the handle of the user. This shock can be annoying over the short term and can have damaging effects on the hand over the long term. Accordingly, it has been found desirable to reduce the shock transmitted by the handle as much as possible, and handles that flex upon impact have been designed as a result.

Although it is desirable to have the hammer handle flex upon impact, flexing at other times is sometimes undesirable. For instance, it is preferable for the hammer not to flex when the claw on a claw hammer is being used. Consequently, a number of designs have been proposed that permit flexing in one direction but not in the other. Forbes U.S. Pat. No. 1,794,008, for example, illustrates in FIG. 1 a hammer handle that is hollow and is spring loaded to permit flexing in one direction but not in the other. The use of a hollow handle has quite apparent drawbacks, however. One of the more recent developments in this area is illustrated by U.S. Pat. Application Ser. No. 056,721 of Whiteford, which employs vertebra members that are individually rigid but flex in one direction when assembled into a column. The Whiteford arrangement substantially avoids the hollow construction of the Forbes hammer but requires a multiplicity of vertebra members.

It is the object of the present invention to provide the one-way flexure of Forbes and Whiteford without the hollow construction of Forbes or the number of parts required by Whiteford.

SUMMARY OF THE INVENTION

The foregoing and related objects are achieved in an impact tool handle that includes an elongated frame member and a flexible handle body substantially encasing the frame member. The frame member is made of resiliently deflectable material and defines a substantially closed figure in a plane defined by the longitudinal axis of the handle and the direction of the impacts to be transmitted by the associated impact tool head to be affixed to one end of the handle. The frame member is discontinuous at one point along its one longitudinal side. The portions of the frame member at the discontinuity are closely spaced in the rest position of the frame member and abut in one direction of flexure of the frame member in the plane defined by the closed figure. This abutment substantially limits flexure in that direction. The frame portions at the discontinuity are movable relative to each other in their other direction of flexure in the plane to permit such flexure. The portions of the frame at the discontinuity are normally disposed in the rest position and are biased into the rest position after flexure in the other direction of flexure, and they are relatively movable in the handle body. Flexure of the flexible handle body and frame member occur concurrently in the other direction of flexure, but flexure of the handle body in the one direction is substantially limited by the frame member.

The frame member may conveniently include guide means at the discontinuity for guiding the portions of the frame member at the discontinuity into abutment in the one direction of flexure. In the preferred embodiment, one of the portions of the frame member at the discontinuity narrows to provide shoulders and a narrowed tab portion extending from them. The other portion of the frame at the discontinuity provides an opening through it through which the tab portion extends. The guide means includes the tab portion and the portion including the opening, and it guides the shoulders into abutment with the other portion of the frame member at the discontinuity in the one direction of flexure. In this version, the frame member provides generally transverse end portions at both ends between its longitudinal sides, and the discontinuity is located substantially at the intersection of the one longitudinal side and one of the transverse portions of the frame member. The portion of the frame at the discontinuity providing the opening is on the transverse portion at the discontinuity, and the portion providing the opening also provides a longitudinally extending flange at its free end parallel to and confining the outward motion the portion of the frame member at the discontinuity providing the tab.

The frame member can comprise a strip formed into the closed figure and being wider than it is thick along most of its length with its width dimension substantially transverse to the plane of the closed figure to provide rigidity in the direction transverse to the plane. It may consist essentially of spring-tempered steel.

The handle body will generally be comprised of a synthetic resin with elastomeric properties.

The teachings can be applied in a hand impact tool having such a handle and including an impact tool head at one end of the handle and locking means anchored to the frame at the one end of the handle and securing the head to the handle.

The head would usually have an opening extending through it in which one end of the handle is seated. The handle body is preferably expansible at the one end of the handle and includes a recess extending longitudinally from the frame to the exterior of the handle body at the one end of the frame. The locking means would include a locking member extending into the recess, anchored in the frame, and urging the handle body against the opening-defining walls of the head to provide firm frictional engagement betweeen the walls and the handle body.

In the preferred embodiment, the frame provides a threaded hole through it that communicates with the longitudinal recess in one end of the handle body. The elongated locking member comprises a screw anchored in the frame by threaded engagement of the threaded hole in the frame.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figure 1:
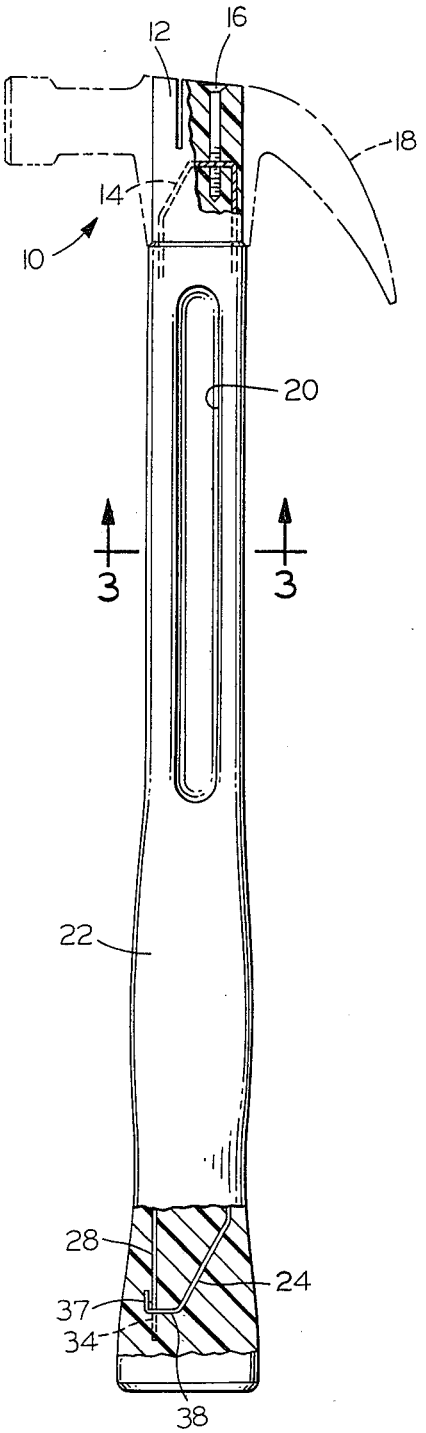
FIG. 1 is a side elevation of a hammer handle following the teachings of the present invention.
Figure 2:
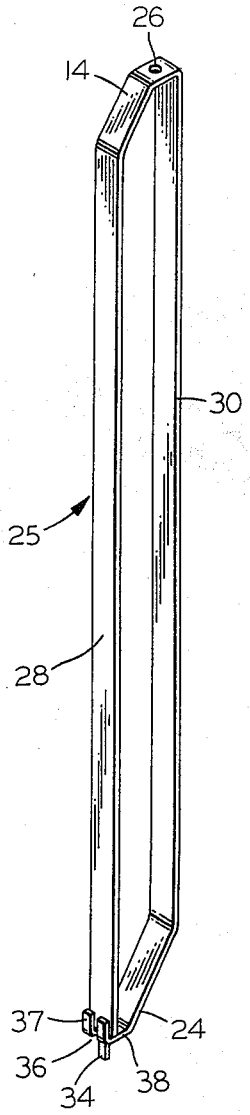
FIG. 2 is a perspective view of the frame used as part of the handle of FIG. 1.
Figure 3:
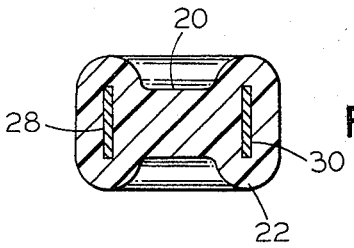
FIG. 3 is a cross-sectional view of the handle taken at line 3—3 of FIG. 1.
Figure 4:
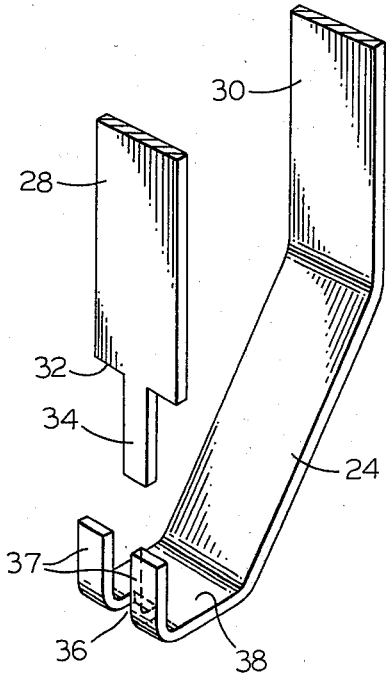
FIG. 4 is an exploded view of the portions of the frame in the region of its discontinuity.

The drawings disclose a hammer handle that includes a flexible spring-steel frame 25 shown in FIG. 2 that is encased in a polyester handle 22, as illustrated in FIGS. 1 and 3. The frame is discontinuous at a point near the bottom of its front longitudinal side, as FIG. 4 shows, and the abutment of a shoulder 32 against a transverse portion 24 of the frame prevents flexing of the frame in one direction but permits flexure in the other direction. Consequently, the handle is permitted to flex in one direction and thus attenuate the shock of impact, but rigidity is maintained in the other direction to permit effective use of the claw side of the head.

The hanner handle of FIG. 1 is shown with a molded hammer body 22. A phantom 10 indicates that the upper end of body 22 is to be received in the customary opening through a hammer head. A spring-steel frame to be described in more detail below can be seen at the cutaway portions of FIG. 1, which show its upper transverse portion 14 and its lower transvers portion 24. A screw 16 is shown received in a recess body 22 that extends longitudinally of the handle. Screw 16 threadedly engages a tapped hole in the upper transverse portion 14 of the frame and is thereby anchored to it. The recess in handle body 22 that receives screw 16 may conveniently be smaller in cross section that screw 16 so that driving of screw 16 into place extends the upper end of body 22 against the walls that define the head socket. Thus, firm frictional engagement is provided. This type of arrangement is shown in more detail in my copending application for a Wedge Construction for a Percussive Tool, hereby incorporated by reference. Although this method of securing the head to the handle has been found to be particularly beneficial in conjunction with the teachings of the present invention, it will be clear that the benefits of the present invention can also be obtained in hammers employing different methods of securing the head to the handle.

The frame member encased in handle body 22 is illustrated in FIG. 2. Frame 25 forms a substantially closed figure in the plane defined by the axis of the handle and the direction in which the hammer is to be swung. It has front and rear longitudinal sides 28 and 30 as well as generally transverse upper and lower portions 14 and 24. Generally transverse upper portion 14 provides the tapped hole 26 in which screw 16 of FIG. 1 is anchored. FIG. 2 also shows that front longitudinal side 28 narrows at its free end to provide a tab 34 that extends through a slot 36 provided in the lower transverse portion 24. This can be seen more clearly in FIG. 4, which is an exploded view that shows a discontinuity at the lower end of front longitudinal side 28. The narrowing of front longitudinal side 28 into tab 34 provides shoulders 32. Shoulders 32 abut a portion 38 of lower transverse portion 24 that provides the slot 36 into which tab 34 is inserted. Portion 38 is bent upwards near its free end to provide a longitudinally extending flange 37 that is parallel to and limits the outward motion of front longitudinal side 28.

Figure 6:
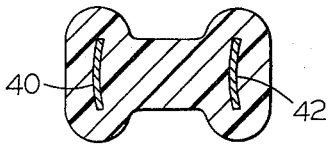
FIG. 6 is a cross-sectional view similar to FIG. 3 of an alternate version of the handle of the present invention.

Frame 25 is made of a steel strip that is considerably wider than it is thick, as FIG. 3 shows. This strip width is beneficial because it contributes resistance to flexure in the direction transverse to the plane of the enclosed figure. Furthermore, it tends to maximize the effectiveness of frame 25 for a given mass of material by concentrating the material close to the front and back of the handle, where the tendency for expansion and contraction is greatest and where frame 25 therefore has the most effect. A further increase in effectiveness may be obtained if the strips making up the frame are curved in the manner illustrated by the alternate version of FIG. 6. The front and rear longitudinal portions 40 and 42, respectively, are both curved in the same direction so as to offer further resistance to flexure of the handle during use of the claw.

When the strip is first formed into the shape shown in FIG. 2, tab 34, slot 36, and flange 37 cooperate to hold the steel strip thus bent against any tendency that it may have to spring out of shape. The frame in this form is then heat treated, and the stresses in the frame ideally would be sufficiently relieved by the heat treating to permit the frame to remain in the proper shape without the action of tab 34, slot 36, and flange 37. However, it has been found convenient for these parts to remain since their removal would merely add another step to the manufacturing process, and they are helpful if the desired stress relief has not been achieved completely. After the frame has been heat treated it is placed in a mold, and handle 22 is injected molded or cast around it.

The spring-like material used in frame member 25 should provide enough toughness and fatigue resistance for the required repetitive flexure of the frame. Satisfactory results may be obtained with SAE 8650 Ni/Cr/Mo steel and have been observed upon extensive testing of samples employing SAE 1070 carbon steel strip 7/16" wide and 0.087 inch thick in a 24-ounce hammer. Desirably, the steel in the frame is heat treated according to the manufacturer's specifications after being formed into the illustrated shape.

In making frames for smaller hammers, thicknesses of 0.077 inch may be used, and 0.125 inch may be used in sledge hammers. It is expected that thicknesses outside of this range can be employed with appropriate adjustments in flexural properties.

Frame 25 could also be made of a synthetic resin having similar properties, such as polyamides, polycarbonates, and fiber-reinforced plastics, such as polyesters. Combinations of materials could also be employed.

The material from which the flexible handle body is fabricated is a synthetic resin elastomer which exhibits high tear strength, oil and chemical resistance, good elastic modulus even at low ambient temperature and high abrasion resistance. It should maintain its characteristics at temperatures as low as −20° C. and up to 80°

C. and preferably 90° C. Generally, the material should have a durometer of about 40–72 D in accordance with the method of ASTM D-2240, and preferably about 45–60; and the tensile strength using the method of ASTM D-638 should be about 3600–6000 psi. The flexural modulus in accordance with the method of ASTM D-790 should be 7–75,000 and preferably about 25–50,000 psi., and the material should have good impact resistance and high notched impact strength of about 15–30 ft. lbs./in. in accordance with the method of ASTM D-256(A). Of the various resins which are available, silicone resins, filled elastomers such as polyisoprene and polyurethane rubber-modified thermoplastics such as ABS and vinyl polymers, and thermoplastic polyester elastomers appear to offer the best combination of properties. In testing, thermoplastic polyester elastomers have proven particularly advantageous and those sold by duPont under the designation HYTREL 5556 and 6346 have proven particularly advantageous.

Frame 25 must be located and supported in the mold for proper positioning of frame 25 in handle body 22. Among the advantages of the method shown in FIG. 1 for securing the head to the handle is that the recess in which screw 16 is received can conveniently be provided by a locating pin that holds the frame in place in the mold. It has also been found that tab 34 is convenient for the purpose of locating the frame within the mold. Except at the positions of voids left by these and other devices for holding the frame in the mold, frame 25 is totally covered by handle body 22 in the illustrated embodiment. Further openings to the frame could be left, but the frame should be encased enough by handle body 22 that flexure of handle body 22 necessitates flexure of frame 25.

It will be noted in connection with FIG. 1 that a depression 20 has been provided in the upper portion of hammer body 22. This can be seen more clearly in FIG. 3. Hammer body 22 is narrowed in this region so that most of the flexure will occur there. It may also be found desirable to extend depression 20 further down the handle than is shown in the preferred embodiment so as to economize on the resin used in the injection molding. This would extend the depression portion down into the grip region. In such a case, a suitable grip could be applied on top of molded body 22 to provide a comfortable contour.

Figure 5:
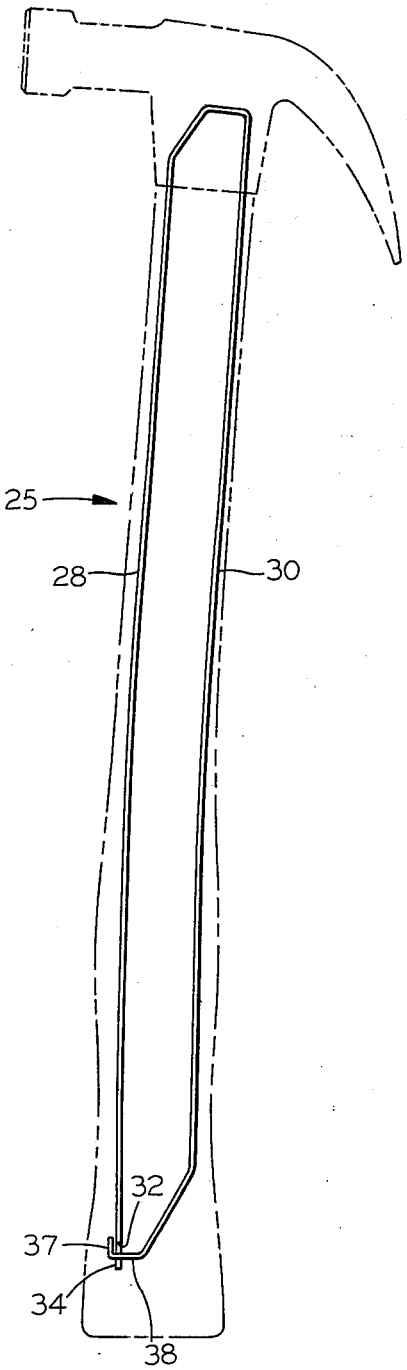
FIG. 5 is a side elevation of the frame shown in its flexed position with the head and the rest of the handle shown in phantom.

In operation, the hammer is employed in the usual manner to strike a workpiece, and the blow results in a tendency for the handle to flex. Such flexure requires expansion of handle body 22 at the front and/or compression at the rear. Since the frame is encased in handle body 22, expansion of its front side causes the forward ends of upper and lower transverse portions 14 and 24 to move apart. This motion is permitted, as FIG. 5 shows, because the front longitudinal side of the frame is discontinuous, allowing shoulder 32 to move out of abutment with portion 38.

The tendency for the rear portion of handle body 22 to compress would also cause the rear ends of the transverse portions 14 and 24 to move together if it were not for the presence of rear portion 30 of frame 24, which resists compression and thus prevents such motion. The front ends of transverse portions 14 and 24 can still move apart, however, and the hammer therefore flexes. The shock transmitted to the hand of the user is accordingly attentuated.

Due to the recovery characteristics of hammer body 22 and frame 25, the handle quickly reassumes its rest position, in which shoulder 32 abuts the portion 38 of frame 25 that provides the slot 36 in which tab 34 is received. Tab 34 is long enough so that it is never totally retracted from slot 36, and it therefore acts as part of a guide means to guide shoulder 32 into abutment with portion 38. Flanges 37 are also long enough to limit outward motion of front longitudinal side 28 during flexure, so flanges 37 also act as part of the guide means. It will be appreciated that the provision of a guide is not absolutely necessary to the effective operation of the hammer, but it has been found convenient.

When the claw side 18 of the hammer head 10 is to be employed, force is applied to the handle in the opposite direction, the direction in which the tendency would be for the front side of the handle to contract and the rear to expand. But the rear side 30 of frame 25 is continuous and therefore prevents transverse portions 14 and 24 from moving apart at their rear ends. Consequently, the rear of the handle cannot expand.

While expansion of the rear of the handle is being prevented, compression of the front side of the handle is also prevented because shoulder 32 is either in abutment or nearly in abutment with portion 38 of the frame when the handle is at rest. This abutment of shoulder 32 and portion 38 prevents the front ends of transverse portions 14 and 24 from moving together even though the front side of the frame is discontinuous, so compression of the front of the handle is prevented. Since compression of the front side and expansion of the rear side are both prevented, the handle cannot flex, and the claw can thus be employed effectively.

Since it is important for the front longitudinal side 28 of frame 25 to be permitted to move freely with respect to handle body 22, it may be found desirable to provide front side 28 with a coating of graphite, tetrafluoroethylene, or some other suitable friction-reducing material, which will also minimize bonding.

Although the present teachings have been illustrated in connection with a preferred embodiment, it should be recognized that the teachings can be carried out in a wide range of devices. For instance, it can readily be appreciated that the discontinuity in the frame could be arranged to permit expansion but prohibit contraction. Discontinuities could even be provided on both sides of the frame, contraction but not expansion allowed on one side and expansion but not contraction being allowed on the other. Numerous other arrangements will be apparent to those shilled in the art in light of the foregoing description.

It can be appreciated that a significant advance has been contributed to the art by the teachings of the present invention. One-way flexure is provided in a handle that is simple in design and readily manufacturable. The handle is substantially solid, requiring no hollow parts. Furthermore, the exterior portions of the handle can be made of relatively compressible and resilient material that is more likely than is the more incompressible material required by some prior art devices to withstand cracking and crazing due to overstrikes. These advantages are affored in a simple handle body molded around a frame that can be formed from a single metal strip.

Having thus described the invention, I claim:

1. An impact tool handle comprising:

a. an elongated frame member of resiliently deflectable material defining a substantially closed figure in a plane defined by the longitudinal axis of the handle and the direction of the impacts to be transmitted by the associated impact tool head to be affixed to one end of the handle, said frame member being discontinuous at one point along one longitudinal side thereof, the portions of said frame member at said discontinuity being closely spaced in the rest position of said frame member and abutting in one direction of flexure of said frame member in the plane defined by the closed figure to substantially limit flexure in that direction and being movable relative to each other in the other direction of flexure thereof in said plane to permit such flexure, said portions of said frame at said discontinuity normally being disposed in said rest position and being biased into said rest position after flexure in said other direction of flexure; and b. a flexible handle body substantially encasing said frame, said portions of said frame member at said discontinuity being relatively movable in said handle body, flexure of said flexible handle body and frame member concurrently occurring in said other direction of flexure, but flexure of said handle body in said one direction being substantially limited by said frame member.

2. The impact tool handle of claim 1 wherein said frame member includes guide means thereon at said discontinuity for guiding said portions of said frame member at said discontinuity into abutment in said one direction of flexure.

3. The impact tool handle of claim 2 wherein said frame consists essentially of spring-tempered steel.

4. The impact tool handle of claim 2 wherein one of said portions of said frame member at said discontinuity narrows to provide shoulders and a narrowed tab portion extending therefrom, the other portion of said frame at said discontinuity providing an opening therethrough through which said tab portion extends, and wherein said guide means includes said tab portion and said portion including said opening, said guide means guiding said shoulders into abutment with said other portion of said frame member at said discontinuity in said one direction of flexure.

5. The imapct tool handle of claim 4 wherein said frame member provides generally transverse end portions at both ends between its longitudinal sides, wherein said discontinuity is located substantially at the intersection of said one longitudinal side and one of said transverse portions of said frame member, wherein said portion of said frame at said discontinuity providing said opening is on said transverse portion at said discontinuity, and wherein said portion providing said opening provides a longitudinally extending flange at its free end parallel to and confining the outward motion said portion of said frame member at said discontinuity providing said tab.

6. The impact tool handle of claim 5 wherein said frame member comprises a strip formed into said closed figure and being wider than it is thick along most of its length, its width dimension being substantially transverse to said plane of said closed figure to provide rigidity in the direction transverse to said plane.

7. The impact tool handle of claim 1 wherein said frame member comprises a strip formed into said closed figure and being wider than it is thick along most of its length, its width dimension being substantially transverse to said plane of said closed figure to provide rigidity in the direction transverse to said plane.

8. The impact tool handle of claim 7 wherein said frame consists essentially of spring-tempered steel.

9. The impact tool handle of claim 1 wherein said frame consists essentially of spring-tempered steel.

10. The impact tool handle of claim 9 wherein said handle body consists essentially of a synthetic resin.

11. The impact tool handle of claim 10 wherein said handle body consists essentially of a thermoplastic polyester elastomer.

12. The impact tool handle of claim 1 wherein said handle body consists essentially of a synthetic resin.

13. The impact tool handle of claim 12 wherein said handle body consists essentially of a thermoplastic polyester elastomer.

14. A hand impact tool comprising:

a. a handle including:

i. an elongated frame member of resiliently deflectable material defining a substantially closed figure in a plane defined by the longitudinal axis of the handle and the direction of the impacts to be transmitted by the associated impact tool head to be affixed to one end of the handle, said frame member being discontinuous at one point along one longitudinal side thereof, the portions of said frame member at said discontinuity being closely spaced in the rest position of said frame member and abutting in one direction of flexure of said frame member in the plane defined by the closed figure to substantially limit flexure in that direction and being movable relative to each other in the other direction of flexure thereof in said plane to permit such flexure, said portions of said frame at said discontinuity normally being disposed in said rest position and being biased into said rest position after flexure in said other direction of flexure; and ii. a flexible handle body substantially encasing said frame, said portions of said frame member at said discontinuity being relatively movable in said handle body, flexure of said flexible handle body and frame member concurrently occurring in said other direction of flexure, but flexure of said handle body in said one direction being substantially limited by said frame member;

b. an impact tool head at one end of said handle; and c. locking means anchored to said frame at said one end of said handle and securing said head to said handle.

15. The hand impact tool of claim 14 wherein said head has an opening extending therethrough in which one end of said handle is seated, wherein said handle body is expansible at said one end of said handle and includes a recess extending longitudinally from said frame to the exterior of said handle body at said one end of said frame, and wherein said locking means includes a locking member extending into said recess, anchored in said frame, and urging said handle body against the opening-defining walls of said head to provide firm frictional engagement therebetween.

16. The hand impact tool of claim 15 wherein said frame provides a threaded hole therethrough communicating with said longitudinal recess in one end of said handle body, and wherein said elongated locking member comprises a screw anchored in said frame by threaded engagement of said threaded hole in said frame.

17. The hand impact tool of claim 15 wherein said handle body consists essentially of a synthetic resin.

18. The hand impact tool of claim 17 wherein said handle body consists essentially of a thermoplastic polyester elastomer.

19. The hand impact tool of claim 18 wherein said frame consists essentially of spring-tempered steel.

* * * * *